United States Patent [19]

Shenk

[11] 4,066,805

[45] Jan. 3, 1978

[54] METHOD OF ACHIEVING A TWO-TONED FIBERBOARD PRODUCT

[75] Inventor: Jay D. Shenk, Lancaster, Pa.

[73] Assignee: Armstrong Cork Company, Lancaster, Pa.

[21] Appl. No.: 659,983

[22] Filed: Feb. 23, 1976

[51] Int. Cl.[2] ..... B05D 3/02; B05D 5/06

[52] U.S. Cl. ..... 427/226; 427/270; 427/275; 427/278; 428/163; 428/164; 428/172

[58] Field of Search ..... 427/264, 270, 275, 226, 427/224, 277, 278; 428/151, 164, 165, 163, 172; 264/132, 129

[56] References Cited

U.S. PATENT DOCUMENTS

| | | | |
|---|---|---|---|
| 151,387 | 5/1874 | Hall | 264/133 |
| 234,610 | 11/1880 | Pruyn et al. | 427/264 |
| 468,321 | 2/1892 | Anderson | 427/376 |
| 2,248,233 | 7/1941 | Heritage | 428/165 |
| 2,818,824 | 1/1958 | Read et al. | 264/132 X |
| 2,902,739 | 9/1959 | Foster | 427/372 |
| 3,068,956 | 12/1962 | Cooley | 181/33 |
| 3,630,817 | 12/1971 | Winkowski | 427/270 X |
| 3,773,543 | 11/1973 | Wartenberg | 427/277 X |

*Primary Examiner*—Ronald H. Smith
*Assistant Examiner*—Evan K. Lawrence

[57] ABSTRACT

Mineral or wood fiberboard is provided with a disrupted or embossed decorative surface, painted overall with a paint containing yellow pigment grade ferric oxide pigment, and the high areas contacted with a heated surface at a temperature such that the ferric oxide pigment is heated to drive off the water of hydration and convert it to a red ferric oxide, thus achieving a two-toned decorative painted board product.

4 Claims, 2 Drawing Figures

Fig. 1
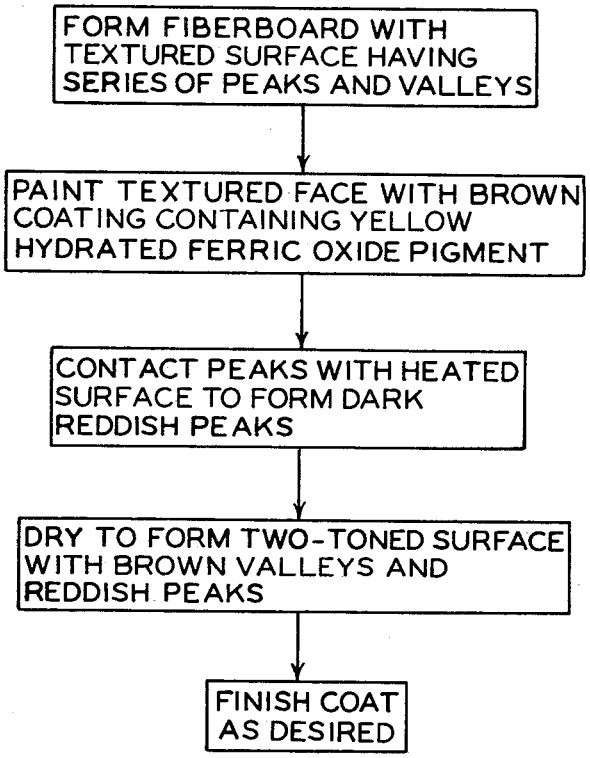
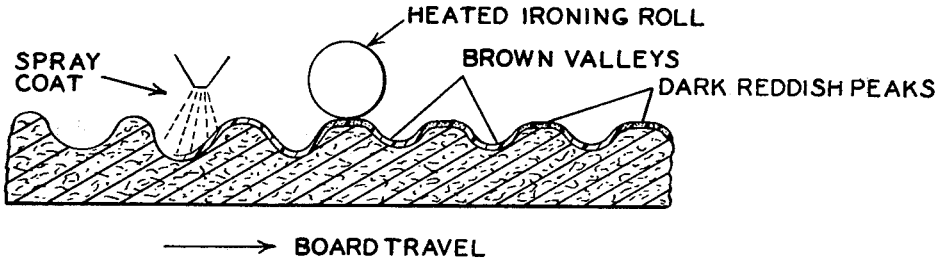
Fig. 2

METHOD OF ACHIEVING A TWO-TONED FIBERBOARD PRODUCT

BACKGROUND OF THE INVENTION

1. Field of the Invention

The subject invention relates to a method for forming a two-toned brown and reddish brown decorative painted surface for insulation and acoustical board products of mineral fiber or wood fiber construction.

2. Description of the Prior Art

It is known from U.S. Pat. No. 3,068,956 that acoustical tile may be formed in an embossed pattern to provide a plurality of pyramidal surfaces, the triangular faces of which may be painted so as to provide different sound and light reflecting properties. There are also references disclosing the coloring of brick by the heat reaction of metal compounds, such as U.S. Pat. No. 2,902,739 and 151,387.

SUMMARY OF THE INVENTION

In accordance with my invention, I have provided a means for providing insulating and acoustical fiberboard products with a disrupted or embossed surface which is painted and then heat treated in a manner such as to provide an overall two-toned appearance, more particularly an appearance having the coloration of industrial cork, i.e., an acoustical board product having a cork-tone overall appearance. In accordance with my invention, a fiberboard product is provided with a disrupted or embossed surface, spray coated overall with a paint containing a yellow ferric oxide pigment, and then contacted or ironed with a heated surface which hits only the high areas of the disrupted or embossed painted surface so as to convert the yellow ferric oxide pigment to the red ferric oxide state by removing the water of hydration and thus provide a two-toned appearance between the highs and the lows. The board may then be provided with a second overall paint application to develop the desired tone. Both paint formulations contain ferric oxide pigments.

BRIEF DESCRIPTION OF THE DRAWING

In the drawing,

FIG. 1 is a flow diagram illustrating the method of producing a two-toned textured fiberboard; and FIG. 2 is a diagrammatic illustration of a fiberboard being treated in accordance with the method.

DESCRIPTION OF THE PREFERRED EMBODIMENT

This invention, as shown in FIG. 1, is a process for the manufacture of a textured mineral fiberboard acoustical product having a series of lands and intervening valleys, which has been painted and treated to give an overall two-toned effect. The coating, which has been applied overall to the textured product, as illustrated in FIG. 2, contains a heat sensitive yellow ferric oxide pigment and, in processing, the lands only are contacted with a heated surface to convert at least some of the ferric oxide pigment from the yellow to red state. The yellow pigment is in the hydrated state, i.e., it is of a lighter coloration, and the conversion of at least some of this pigment by removal of the water of hydration develops a deeper red tone and the overall effect is somewhat similar to that produced in a cork tile.

The chemical mechanism may be illustrated as follows:

$$Fe_2O_3 \cdot xH_2O \text{ (yellow)} \xrightarrow[\Delta]{350^\circ \text{ F.}} Fe_2O_3 \text{ (red)} + xH_2O$$

Conventional means and formulations are utilized in producing the textured board product. Thus, a slurry of mineral wool, clay, starch, cellulosic fibers from newsprint, glass fibers, alum and a dispersing agent is initially slurried with water to give a slurry consistency of about 3% to 5% solids and then flowed out onto the forming wire of a Fourdrinier, passed over a free drainage area and conventional suction boxes to form a water-laid mat, either wet textured with a conventional needle roll, for example, or dried and then textured, to provide a disrupted surface. The board-forming mat, alternatively, can be embossed rather than textured. The board-forming mat is cut to size after wet texturing, dried in an oven, back sanded and back coated as desired with conventional coatings such as a melamine-urea formaldehyde based aqueous paint system, at which point it is ready for further treatment in accordance with this invention. Alternatively, the texturing or embossing may be accomplished after the boards have been cut and dried. The dried and coated boards and/or panels formed in accordance with the above are initially spray coated overall with a coating formulation containing pigment grade yellow ferric oxide pigment. The board is then subjected to a treatment with a hot surface such as a hot ironing roll to convert at least some of the yellow ferric oxide pigment to red ferric oxide pigment on those points of the board surface, the lands, with which the hot surface comes into contact.

Where desired, a second coat, either clear or tinted, may be after applied. As will be obvious to anyone skilled in the art, texturing may be done in either the wet or dry state, and the boards may be cut to final size either before or after the application of the two-toned paint finish.

The following example will serve to more fully illustrate this invention.

A slurry is formed from water and the following ingredients:

| Ingredients | Percent by Weight (Dry) |
|---|---|
| Mineral Wool | 70.15 |
| Mississippi M&D Clay | 5.0 |
| Starch | 9.0 |
| Pulped Newsprint | 15.0 |
| Glass Fibers | 0.5 |
| Alum | 0.31 |
| Polyethylene Oxide Dispersant | 0.04 |

Sufficient water is added with agitation to form a slurry having a consistency of approximately 4% by weight solids. This slurry is then flowed out from a conventional head box onto the board-forming wire of the Fourdrinier and water is continually drained therefrom, both by free drainage and with the aid of conventional suction boxes. In this particular embodiment of the invention, the board-forming mat, while water is still being removed, is wet textured with a needle roll to provide a disrupted surface with lands and valleys overall. The textured board-forming mat, which has a thickness of about 0.8 inches, is then cut to a handable dimension, for example a 4 × 6 foot panel, passed through an oven (at an oven temperature of about 500° F. and a one-hour dwell time) to dry the board, after which the panels are back sanded. The dried board is then back coated with a conventional melamine-urea formaldehyde based aqueous paint, dried and dry punched to fissure or further disrupt the surface.

This textured board is then spray coated overall with a coating of the following formulation applied at a rate of approximately 14 grams per square foot.

| Prime Coat | |
|---|---|
| Ingredients | Parts by Weight (grams) |
| Water | 531.5 |
| Pigmens: | |
| Red ferric oxide slurry (Harshaw W-3040) (70% solids) | 27.4 |
| Hydrated yellow ferric oxide slurry (Harshaw W-1021) (57% solids) | 78.1 |
| Carbon black slurry (Harshaw W-7012) (40% solids) | 10.6 |
| Klondyke clay slurry (70% solids) | 343.0 |
| Cellulose thickener (Natrosol 250 HHR) | 0.4 |
| Vegetable protein binder (Procote 150) | 27.4 |
| Ammonia solution (28%) | 2.9 |
| Formaldehyde solution (37%) | 0.9 |
| Minor amounts of preservatives and defoamer | 1.7 |
| Total | 1023.9 |

In this formulation, the preservatives used were Betz RX-16 Slime-Trol (0.3 parts) and Dowicide G (0.9 parts) and the defoamer used was Colloid 680 (0.5 parts). Many other commercially available preservatives and defoamers would work equally as well. The slurries and solutions are all water based. The pigment-filler concentrations have been adjusted to provide on drying a pleasing brown color and obviously substitutions and adjustments in the amounts of the several ingredients including pigments and fillers could be made by one skilled in the arts to vary the effect desired.

The coated board is next passed into a nip between two rollers, the uppermost roller being a metallic ironing roll heated to between 1100° F. and 1200° F., and the coated peaks or lands are heated to drive off the water of hydration of the yellow ferric oxide pigment to form an unhydrated red oxide and change the color from brown to a darker red hue. Since this is a textured surface with which the ironing roll comes into contact, only the peaks or lands are contacted by the ironing roll, and the valleys are unaffected thereby such that the color of coating in the valleys remains the original brown hue. Drying is then completed by passing the panels through an oven (350° to 400° F.) with a dwell time of 30 seconds.

If desired, a second coat, which may be either clear or tinted, may be applied and dried after the panels have been cut to size and tenoned. An example of a second coat which would provide a greater degree of abrasion resistance to the overall coated board and tone down the red peaks is as follows:

| Finish Coat | |
|---|---|
| Ingredients | Parts by Weight (grams) |
| Water | 553.0 |
| Pigments: | |
| Red ferric oxide slurry (Harshaw W-3040) (70% solids) | 10.8 |
| Hydrated yellow ferric oxide slurry (Harshaw W-1021) (57% solids) | 32.8 |
| Carbon black slurry (Harshaw W-7012) (40% solids) | 6.8 |
| Phthalocyanine blue slurry (Harshaw W-413) (38% solids) | 0.5 |
| Calcium carbonate filler (Camel-Tex) | 189.6 |
| Polyacrylic acid thickener - Acrysol ASE-60 | 14.8 |
| Triethylamine | 2.4 |
| Preservative and defoamer | 1.8 |
| Dispersant - tetrasodium pyrophosphate | 0.7 |
| Polyvinylidene chloride copolymer binder (Vitard M) (54% solids) | 203.2 |
| Total | 1016.4 |

In this formulation, the preservative used was Troysan 174A (0.5 parts) and a mixture of defoamers, 0.6 parts Foamtrol and 0.7 parts Colloid 680 was used.

Conventionally, the second coat is applied at a rate of about 8 to 9 grams per square foot and dried by passing through an oven with a dwell time of approximately 40 seconds at a temperature of 325° F. to 350° F. The finished product has a brown to red two-toned appearance similar in appearance to industrial cork.

What is claimed is:

1. The method of forming a textured fiberboard product having a series of peaks or lands and intervening valleys and having a two-toned painted surface which varies from a brown to a deeper redish tone comprising:

a. forming a textured fiberboard having a series of peaks or lands and intervening valleys;

b. painting the textured surface overall with a liquid coating containing a yellow hydrated ferric oxide pigment to form an overall brown coating;

c. contacting said peaks or lands with a heated surface at a temperature and for a time sufficient to drive off the water of hydration associated with the yellow hydrated ferric oxide pigment, thus converting the yellow ferric oxide to a red ferric oxide to provide the peaks or lands with a darker reddish hue contrasting with the original brown color of the unaffected coated valleys; and thereafter d. drying the coated fiberboard.

2. The method in accordance with claim 1 in which the textured fiberboard is a mineral fiberboard.

3. The method in accordance with claim 2 in which the brown color of said product is adjusted to the desired shade of brown, more closely approximating a cork-tone, by blending additional pigmentation with said coating prior to painting the textured surface.

4. The method in accordance with claim 3 in which an additional overall coat is applied to the painted surface after said drying step (d) to tone down the contrast between the lands or peaks and the valleys.

* * * * *